US008643593B2

(12) United States Patent
Chang et al.

(10) Patent No.: US 8,643,593 B2
(45) Date of Patent: Feb. 4, 2014

(54) METHOD AND APPARATUS OF COMPENSATING IMAGE IN A BACKLIGHT LOCAL DIMMING SYSTEM

(75) Inventors: Chih-Kai Chang, Taichung (TW); Yu-Li Wu, Hsinchu (TW)

(73) Assignee: Orise Technology Co., Ltd., Hsinchu Science Park (TW)

( * ) Notice: Subject to any disclaimer, the term of this patent is extended or adjusted under 35 U.S.C. 154(b) by 122 days.

(21) Appl. No.: 13/439,158

(22) Filed: Apr. 4, 2012

(65) Prior Publication Data

US 2013/0016141 A1 Jan. 17, 2013

(30) Foreign Application Priority Data

Jul. 12, 2011 (TW) ..... 100124619 A

(51) Int. Cl.
*G09G 3/36* (2006.01)

(52) U.S. Cl.
USPC ..... 345/102; 345/89; 345/204; 345/211; 345/690; 349/61; 362/97.1; 362/97.2

(58) Field of Classification Search
USPC ..... 345/38, 50, 84, 87, 89, 102, 173–184, 345/204, 211, 690; 349/56, 61, 64, 68; 362/97.1–97.3
See application file for complete search history.

(56) References Cited

U.S. PATENT DOCUMENTS

2010/0053222 A1* 3/2010 Kerofsky ..... 345/690
2011/0074803 A1* 3/2011 Kerofsky ..... 345/589
2011/0273495 A1* 11/2011 Ward et al. ..... 345/694

* cited by examiner

*Primary Examiner* — Lun-Yi Lao
*Assistant Examiner* — Insa Sadio
(74) *Attorney, Agent, or Firm* — Bacon & Thomas, PLLC

(57) ABSTRACT

An apparatus compensates image in a backlight local dimming system for estimating pixels of the image after backlight spreading of a plurality of backlight sources in the backlight local dimming system. The apparatus includes a block dimming value decision unit, a quality/power-saving priority decision unit, a temporal filter, a backlight spread approximation unit, and an image compensation unit. The block dimming value decision unit calculates an average value, a maximum value and a initial value for each image block. The quality/power-saving priority decision unit generates a backlight control signal based on the average value, the initial value, and two thresholds. The temporal filter adaptively generates a backlight pulse width modulation signal based on the backlight control signal. The backlight spread approximation unit generates a backlight spread image based on the backlight pulse width modulation signal. The image compensation unit compensates the image based on the backlight spread image.

22 Claims, 5 Drawing Sheets

```
library ieee;
use ieee.std_logic_1164.ALL;
use ieee.std_logic_arith.ALL;
entity max_search is
port(
  rst, clk       :in  std_logic;
  piexl_in0  :in std_logic_vector(7 downto 0);   piexl_in1  :in std_logic_vector(7 downto 0);
  piexl_in2  :in std_logic_vector(7 downto 0);   piexl_in3  :in std_logic_vector(7 downto 0);
  piexl_in4  :in std_logic_vector(7 downto 0);   piexl_in5  :in std_logic_vector(7 downto 0);
  piexl_in6  :in std_logic_vector(7 downto 0);   piexl_in7  :in std_logic_vector(7 downto 0);
  piexl_in8  :in std_logic_vector(7 downto 0);   max         :out std_logic_vector(7 downto 0)

);
end max_search;
architecture rtl of max_search is
  type piexl_array is array(8 downto 0) of std_logic_vector(7 downto 0);
process(clk, rst)
 signal  pix_tmp: piexl_array;
 variable v :std_logic_vector(7 downto 0)
 begin
  if(rst='1') then
    for i in 8 downto 0 loop
     pix_tmp(i) := "00000000";
    end loop;
  elsif(clk='1' and clk'event) then
    pix_tmp(0) <= piexl_in0;   pix_tmp(1) <= piexl_in1;
    pix_tmp(2) <= piexl_in2;   pix_tmp(3) <= piexl_in3;
    pix_tmp(4) <= piexl_in4;   pix_tmp(5) <= piexl_in5;
    pix_tmp(6) <= piexl_in6;   pix_tmp(7) <= piexl_in7;
    pix_tmp(8) <= piexl_in8;
  end if;
  if(rst='1') then
    v:='0';
  elsif(clk='1' and clk'event) then
    for j in 0 to 7 loop
      if (conv_integer(pix_tmp(j+1))< conv_integer(pix_tmp(j) )) then
        v := pix_tmp(j);
      else
        v := pix_tmp(j+1);
      end if;
     end loop;
   end if;
  max <= v;
end process;
end rtl;
```

FIG. 3

METHOD AND APPARATUS OF COMPENSATING IMAGE IN A BACKLIGHT LOCAL DIMMING SYSTEM

CROSS REFERENCE TO RELATED APPLICATION

This application claims the benefits of the Taiwan Patent Application Serial Number 100124619, filed on Jul. 12, 2011, the subject matter of which is incorporated herein by reference.

BACKGROUND OF THE INVENTION

1. Field of the Invention

The present invention relates to the technical field of backlight local dimming and, more particularly, to a method and apparatus of compensating image in a backlight local dimming system.

2. Description of Related Art

Multiple backlight sources are typically used in the current liquid crystal display (LCD) device for controlling a plurality of display areas of the LCD device to save the power. The backlight local dimming indicates that the backlight sources of the LCD device are adjusted according to the image brightness, but not in a state of full brightness.

Typically, the backlight sources of the LCD device are at full brightness. The display of a dark frame is achieved by reducing the transmittance of liquid crystal, which has no help for reducing the power consumption. By contrast, the backlight local dimming allows the brightness of backlight source to be varied with dark and light frames, so the brightness of backlight source is reduced when a dark frame is displayed. Thus, the entire amount of power consumption of the backlight is reduced.

In addition to the power consumption reduction, the backlight local dimming can also improve the frame quality of the LCD device. For example, the high dynamic contrast is dramatically increased. In addition, the backlight local dimming can be applied in the backlight sources to further increase the number of gray scales on the LCD device.

In the entire power consumption of an LCD device, the backlight module typically occupies the largest proportion, about 66%. Further, the developing LCD devices trend to a large size, so the frames to be displayed require higher brightness, which consumes more power. In this case, from a viewpoint of power saving, the backlight local dimming can relatively reduce the amount of power consumption on the large LCD device. In addition, the increase on the frame quality provides the optimal solution for the current backlight sources.

A typical backlight local dimming can increase the frame contrast and reduce the power consumption, but the inappropriate backlight decision and image compensation may reduce the image quality, including color washout, ripples, no control of highlight detail, flickers, and inappropriate backlight on dark and light frames. Therefore, it is desirable to provide an improved backlight local dimming to mitigate and/or obviate the aforementioned problems.

SUMMARY OF THE INVENTION

The object of the present invention is to provide a method and apparatus of compensating image in a backlight local dimming system, which can reduce the amount of computation, reduce the required area of hardware circuitry, and improve the image quality.

In one aspect of the invention, there is provided an apparatus of compensating image in a backlight local dimming system for estimating pixels of the image after backlight spreading of a plurality of backlight sources in the backlight local dimming system. The backlight sources are arranged in a matrix form. The image is divided into a number of image blocks corresponding to the plurality of backlight sources, respectively. The apparatus comprises: a block dimming value decision unit for receiving the image and calculating an average value and a maximum value for each image block, so as to calculate an initial value based on the average value and the maximum value for the image block; a quality/power-saving priority decision unit connected to the block dimming value decision unit for generating a backlight control signal based on the average value, the initial value, a first threshold, and a second threshold for the image block; a temporal filter connected to the quality/power-saving priority decision unit for adaptively generating a backlight pulse width modulation signal based on the backlight control signal for the image block; a backlight spread approximation unit connected to the temporal filter for generating a backlight spread image corresponding to the image based on the backlight pulse width modulation signal for the image block; and an image compensation unit connected to the backlight spread approximation unit for compensating the image based on the backlight spread image, so as to generate a compensated image.

In another aspect of the invention, there is provided a method of compensating image in a backlight local dimming system for estimating pixels of the image after backlight spreading of a plurality of backlight sources in the backlight local dimming system. The backlight sources are arranged in a matrix form. The image is divided into a number of image blocks corresponding to the plurality of backlight sources, respectively. The method comprises the steps of: a block dimming value decision step for receiving the image and calculating an average value and a maximum value for each image block, so as to calculate an initial value based on the average value and the maximum value for the image block; a quality/power-saving priority decision step for receiving the average value and initial value of each image block and generating a backlight control signal based on the average value, the initial value, a first threshold, and a second threshold for the image block; a temporal filtering step for adaptively generating a backlight pulse width modulation signal based on the backlight control signal for each image block; a backlight spread approximation step for generating a backlight spread image corresponding to the image based on the backlight pulse width modulation signal for each image block; and an image compensation step for compensating the image based on the backlight spread image, so as to generate a compensated image.

Other objects, advantages, and novel features of the invention will become more apparent from the following detailed description when taken in conjunction with the accompanying drawings.

BRIEF DESCRIPTION OF THE DRAWINGS

FIG. 3 is a schematic graph of calculating a maximum value for each image block that is executed by a computation unit in accordance with an embodiment of the invention;

DETAILED DESCRIPTION OF THE PREFERRED EMBODIMENT

Figure 1:
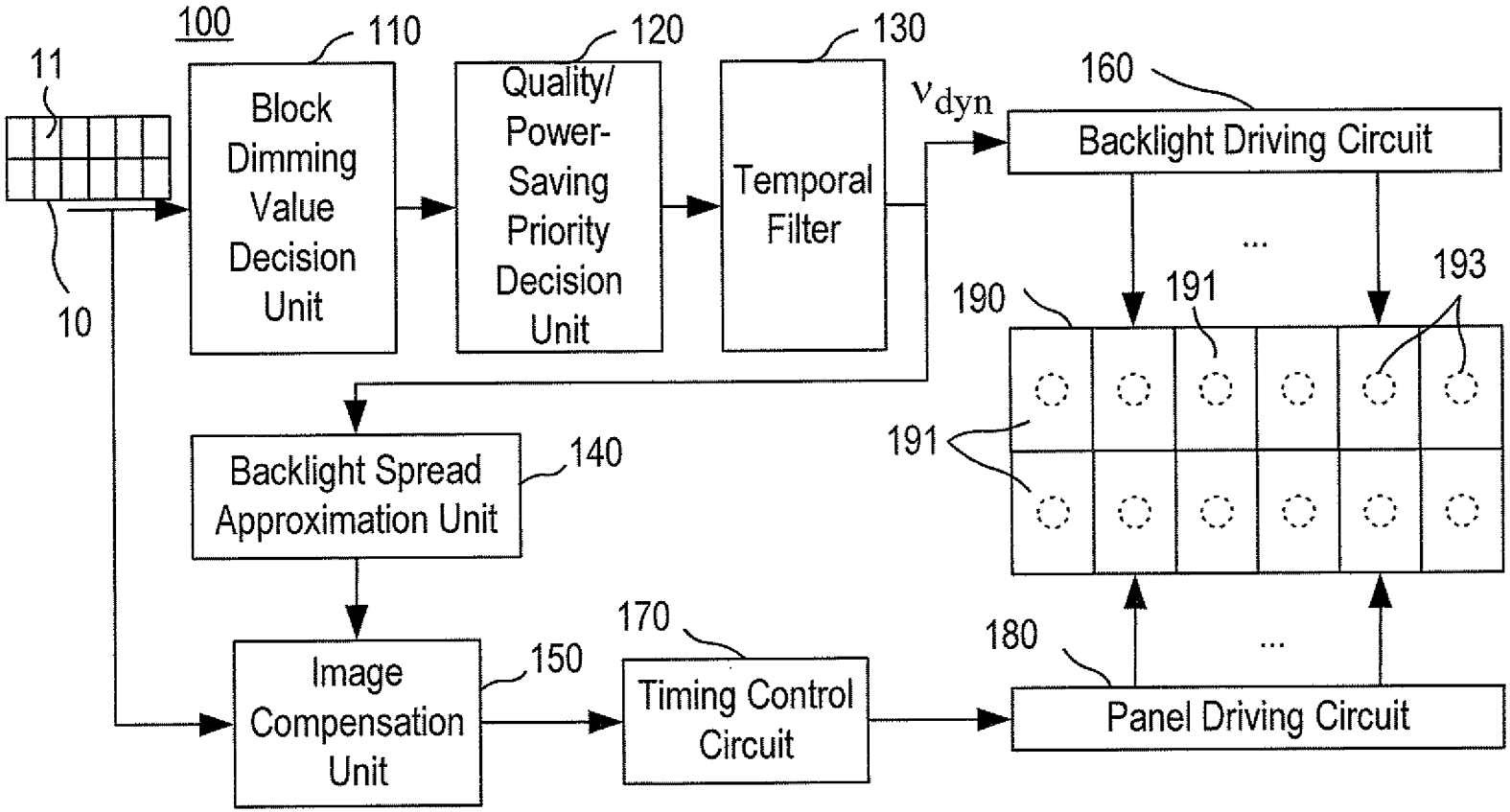
FIG. 1 is a block diagram of an apparatus of compensating image in a backlight local dimming system in accordance with an embodiment of the invention.

FIG. 1 is a block diagram of an apparatus 100 of compensating image in a backlight local dimming system in accordance with an embodiment of the invention. In FIG. 1, the apparatus 100 is used in a liquid crystal display (LCD) device. The LCD panel 190 of the LCD device is implemented with a plurality of backlight sources 193 in a matrix arrangement at the back side of the LCD panel 190. The image 10 displayed on the LCD panel 190 is divided into a plurality of image blocks 11 respectively corresponding to the backlight sources 193. Namely, the LCD panel 190 includes a plurality of blocks 191 arranged in a matrix form that correspond to the image blocks 11 for displaying the image, and further correspond to the backlight sources 193, respectively. Each of the backlight sources 193 is driven and controlled by a backlight driving circuit 160 to thus provide a light required for displaying on each block 191 of the LCD panel 190.

As shown in FIG. 1, the LCD panel 190 is divided into, for example, blocks 191 of two rows and six columns based on the number of backlight sources 193. In other embodiments, for an example of LCD panels 190 with a resolution of 1920×1080, the blocks 191 are arranged in a matrix form of eight rows and 16 columns, i.e., the number of backlight sources 193 is 16×8, and in this case each block has 120×135 pixels. The resolution of the image to be displayed on the LCD panel 190 is not certainly equal to that of the LCD panel 190. However, after being processed by a scaler (not shown) of the LCD panel 190, the resolution of the image to be displayed on the LCD panel 190 is the same as that of the LCD panel 190. Therefore, the image 10 can be divided into a number of image blocks 11 corresponding to the plurality of backlight sources 193, respectively.

The apparatus 100 estimates the values of pixels of the image 10 after backlight spreading of the backlight sources 193 in the backlight local dimming system, so as to generate a backlight spread image for performing an image compensation operation on the image 10. The backlight sources 193 are arranged in a matrix form. The image 10 is divided into a plurality of image blocks 11 corresponding to the backlight sources 193, respectively. The apparatus 100 includes a block dimming value decision unit 110, a quality/power-saving priority decision unit 120, a temporal filter 130, a backlight spread approximation unit 140, an image compensation unit 150, a backlight driving circuit 160, a timing control circuit 170, and a panel driving circuit 180.

The block dimming value decision unit 110 receives the image and calculates an average value $v_{avg}$ and a maximum value $v_{max}$ for each image block, so as to further calculate an initial value $v_{init}$ based on the average value $v_{avg}$ and the maximum value $v_{max}$ for the image block.

Figure 2:
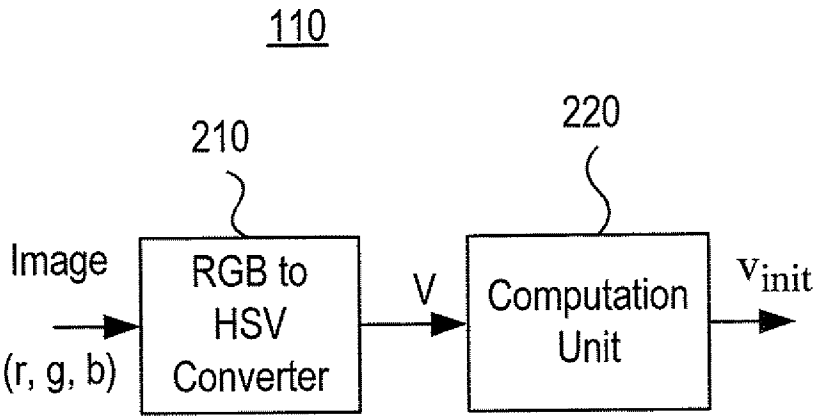
FIG. 2 is a block diagram of a block dimming value decision unit in accordance with an embodiment of the invention.

FIG. 2 is a block diagram of the block dimming value decision unit 110 in accordance with an embodiment of the invention. The block dimming value decision unit 110 includes an RGB to HSV converter 210 and a computation unit 220.

The RGB to HSV converter 210 converts the image 10 from RGB format into HSV (hue, saturation, and value) format. The format conversion performed by the RGB to HSV converter 210 can be expressed as follows.

$$v=\max(r,g,b),$$

where r, g, b indicate a red value, a green value, a blue value of one pixel of the image 10, and v indicates v value (of the HSV format) of the pixel of the image 10.

The computation unit 220 is connected to the RGB to HSV converter 210 for calculating the average value $v_{avg}$ and the maximum value $v_{max}$ for each image block 11 from the image 10 and further calculate the initial value $v_{init}$ based on the average value $v_{avg}$ and the maximum value $v_{max}$ for the image block 11.

The calculation of average value $v_{avg}$ for each image block 11 executed by the computation unit 220 can be expressed as follows:

$$v_{avg} = \frac{1}{N}\sum_{i=1}^{N} v_i,$$

where $v_i$ indicates v value of i-th pixel of an image block 11 from the image 10 in HSV format, N indicates the number of pixels of the image block 11, and $v_{avg}$ indicates an average value of the image block 11. In this embodiment, the average value $v_{avg}$ is obtained from dividing the sum of $v_1$-$v_N$ by N. Alternatively, if the number of pixels of the image block 11 is the power of 2, for example, the number of pixels of the image block 11 being 8×8 (N=64), it is applicable to first sum up the pixel values $v_1$-$v_N$ and then shift it to right by six bits for thus avoiding the use of a divider.

The calculation of maximum value $v_{max}$ for each image block 11 executed by the computation unit 220 can be expressed as follows:

$$v_{max}=\max(v_1,v_2,v_2,\ldots,v_N),$$

where $v_{max}$ indicates the maximum value of the image block 11. FIG. 3 is a schematic graph of calculating the maximum value for each image block 11 that is executed by the computation unit 220 in accordance with an embodiment of the invention. As shown in FIG. 3, a VHDL code is described, but not limited to it. One skilled in the art can rewrite the operation by a Verilog or System C code.

The calculation of initial value $v_{init}$ for each image block 11 executed by the computation unit 220 can be expressed as follows:

$$v_{init}=R_S\times v_{max}+(1-R_S)\times v_{avg},$$

where $v_{init}$ indicates an initial value of the image block 11, and $R_S$ is a weighting factor with a value of 0-1.

The quality/power-saving priority decision unit 120 is connected to the block dimming value decision unit 110 for generating a backlight control signal based on the average value $v_{avg}$, the initial value $v_{init}$, a first threshold THD1, and a second threshold THD2 for each image block 11.

The backlight control signal $v_{plt}$ generated by the quality/power-saving priority decision unit 120 can be expressed as follow:

$$v_{plt} = \begin{cases} \dfrac{v_{init}\times BL_H}{THD2}, & \text{if } (v_{avg} < THD1) \text{ and } (v_{init} < THD2) \\ BL_H & \text{else,} \end{cases}$$

where $v_{plt}$ indicates the backlight control signal of the image block 11, $BL_H$ indicates a highest backlight dimming value, THD1 indicates the first threshold, THD2 indicates the second threshold. The second threshold THD2 is greater than the first threshold THD1.

Further, when the values of the pixels in the image block 11 are relatively high, a clipping effect is likely to occur in a compensation image, resulting in losing the details of lighter portions of the image. Thus, when the values of a group of pixels in an image block 11 are relatively high, the average value $v_{avg}$ and the initial value $v_{init}$ become relatively large due to a large maximum value $v_{max}$, which causes a full brightness ($v_{plt}$=$BL_H$) of the backlight source from the block 191 of the LCD panel 190 corresponding to the image block 11. Namely, when the values of a group of pixels in the image block 11 are relatively high, the maximum value $v_{max}$, average value $v_{avg}$, and initial value $v_{init}$ of the image block 11 become large, so that ($v_{avg}$<THD1) and ($v_{avg}$<THD2) in the equation is not satisfied and the backlight source from the block 191 of the LCD panel 190 corresponding to the image block 11 is a full brightness ($v_{plt}$=$BL_H$). In this case, the subsequent compensation multiplier is reduced to eliminate the clipping effect.

The first threshold THD1 and the second threshold THD2 are adjustable. When the entire apparatus 100 focuses on power-saving, the quality/power-saving priority decision unit 120 increases the first threshold THD1 and the second threshold THD2. In this case, most of the image blocks 11 proceed with the backlight local dimming. When the entire apparatus 100 focuses on image quality, the quality/power-saving priority decision unit 120 reduces the first threshold THD1 and the second threshold THD2. In this case, most of the image blocks 11 do not proceed with the backlight local dimming.

The temporal filter 130 is connected to the quality/power-saving priority decision unit 120 for adaptively generating a backlight pulse width modulation signal ($v_{dyn}$) in accordance with the backlight control signal for each image block 11. Since each image block 11 corresponds to one block 191 on the LCD panel 190, a backlight pulse width modulation signal ($v_{dyn}$) generated for each image block 11 is applied to the backlight driving circuit 160 for driving the corresponding block 191 on the LCD panel 190.

The backlight pulse width modulation signal ($v_{dyn}$) generated by the temporal filter 10 can be expressed as follows:

$$v_{dyn} = r_d \times v_{plt}^{(k)} + (1 - r_d) \times v_{plt}^{(k-1)},$$

$$r_d = B + \left\lfloor \frac{\sum_{j=1}^{M} (v_{avg}^{(k)})_j - \sum_{j=1}^{M} (v_{avg}^{(k-1)})_j}{L} \right\rfloor \times \frac{(1-B)}{T},$$

where $r_d$ indicates a weighting factor, M indicates a number of image blocks, $v_{plt}^{(k)}$ indicates a backlight control signal of an image block 11 from a current frame of the image 10, $v_{plt}^{(k-1)}$ indicates a backlight control signal of an image block 11 of a previous frame from the image 10, $v_{avg}^{(k)}$ indicates an average value of v value of HSV format of the current frame of the image 10, $v_{avg}^{(k-1)}$ indicates an average value of v value of HSV format from the previous frame of the image 10, B indicates an intercept of the temporal filter, T indicates a varying step of the temporal filter, and L indicates a varying period of the temporal filter.

The current frame and the previous frame are used in a temporal axis to adaptively decide the backlight pulse width modulation signal ($v_{dyn}$). When the average values $v_{avg}^{(k)}$, $v_{avg}^{(k-1)}$ of entire brightness between the current frame and the previous frame are similar, the information associated with the previous frame is used in backlight local dimming. Otherwise, the information associated with the current frame is used in backlight local dimming. When the average values $v_{avg}^{(k)}$, $v_{avg}^{(k-1)}$ of entire brightness between the current frame and the previous frame are similar, it indicates that the images between the previous frame and the current frame have a very high similarity. In this case, the information associated with the previous frame is used in backlight local dimming to avoid the inter-frame flickering effect. When a darker frame follows a light frame, the average values $v_{avg}^{(k)}$, $v_{avg}^{(k-1)}$ of entire brightness between the current frame and the previous frame are not similar. In this case, the information associated with the current frame is used in backlight local dimming to avoid backlight from having insufficient brightness for a light frame and from having insufficient darkness for a darker frame.

The backlight spread approximation unit 140 is connected to the temporal filter 130 for generating a backlight spread image corresponding to the image based on the backlight pulse width modulation signal ($v_{dyn}$) for each image block 11.

Figure 4:
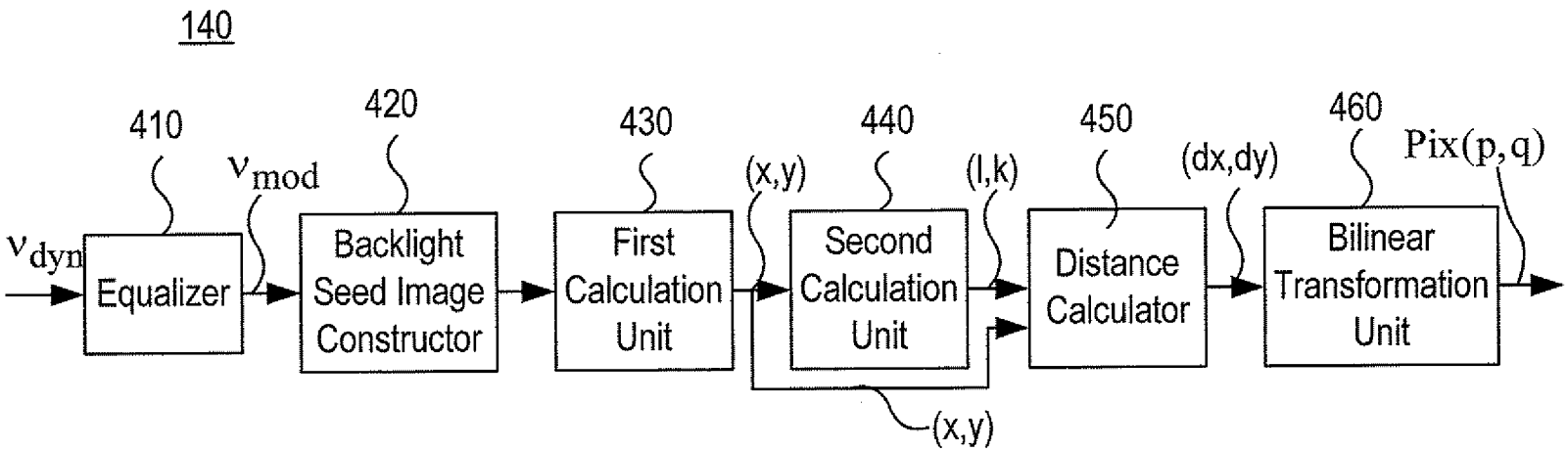
FIG. 4 is a block diagram of a backlight spread approximation unit in accordance with an embodiment of the invention.

FIG. 4 is a block diagram of the backlight spread approximation unit 140 in accordance with an embodiment of the invention. As shown in FIG. 4, the backlight spread approximation unit 140 includes an equalizer 410, a backlight seed image constructor 420, a first calculation unit 430, a second calculation unit 440, a distance calculator 450, and a bilinear transformation unit 460.

The equalizer 410 is connected to the temporal filter 130 for receiving the backlight pulse width modulation signal ($v_{dyn}$) for each image block 11 and performing an equalization operation on the backlight pulse width modulation signal to generate an equalization signal corresponding to the image block.

The backlight seed image constructor 420 is connected to the equalizer 140 for generating a backlight seed image based on the equalization signals.

The first calculation unit 430 is connected to the backlight seed image constructor 420 for calculating a plurality of x-y positions corresponding to the backlight seed image based on a backlight spread image.

The second calculation unit 440 is connected to the first calculation unit 430 for calculating a coordinate of the backlight seed image based on the positions.

The distance calculator 450 is connected to the second calculation unit 440 for calculating distance differences between the positions and the coordinate of backlight seed image.

The bilinear transformation unit 460 is connected to the distance calculator 450 for performing a bilinear transformation on the pixels of the backlight seed image and the distance differences so as to further generate the backlight spread image, wherein a pixel positioned at a coordinate (p, q) of the backlight spread image has a gray value of Pix(p,q).

The backlight spread approximation unit 140 simulates the backlight sources respectively occupying an area at the center of each block 191, so that the backlight spread starts with the center of each area to thus generate the backlight spread image meeting the actual condition.

The image compensation unit 150 is connected to the backlight spread approximation unit 140 for compensating the image 10 based on the backlight spread image so as to generate a compensated image. The image compensation operation performed by the image compensation unit 150 can be expressed as follows:

$$r_{comp} = \begin{cases} r, & \text{if } Pix'(p,q) = 0 \\ r \times \left(\frac{THD3}{Pix'(p,q)}\right)^{\frac{1}{\gamma}}, & \text{else,} \end{cases}$$

$$g_{comp} = \begin{cases} g, & \text{if } Pix'(p,q) = 0 \\ g \times \left(\frac{THD3}{Pix'(p,q)}\right)^{\frac{1}{\gamma}}, & \text{else,} \end{cases}$$

$$b_{comp} = \begin{cases} b, & \text{if } Pix'(p,q) = 0 \\ b \times \left(\frac{THD3}{Pix'(p,q)}\right)^{\frac{1}{\gamma}}, & \text{else,} \end{cases}$$

$$Pix'(p,q) = \begin{cases} Pix(p,q), & \text{if } Pix(p,q) < (2 \times THD3 - 256) \\ \frac{Pix(p,q)}{2} + \frac{1}{2} \times (2 \times THD3 - 256), & \text{if } Pix(p,q) \geq (2 \times THD3 - 256) \end{cases}$$

where r, g, b indicate red value, green value, blue value of one pixel of the image 10, $r_{comp}$, $g_{comp}$, $b_{comp}$ indicate red value, green value, blue value of one pixel of the compensated image, Pix(p, q) indicates gray value of a pixel at a coordinate (p, q) of the backlight spread image, $\gamma$=2.2, and THD3 indicates a third threshold.

When Pix'(p,q)≠0, $r_{comp}$, $g_{comp}$, $b_{comp}$ are respectively multiplied by the same compensation multiplicator $$\left(\frac{THD3}{Pix'(p,q)}\right)^{\frac{1}{\gamma}},$$

to thus reduce the color shift between the image 10 and the compensated image. The third threshold indicates a parameter associated with the compensation magnitude. The compensation reaches to the most magnitude when THD3=255, and the gray value (Pix(p,q)) of the pixel of the backlight spread image is smaller than the third threshold when THD3<255. Otherwise, an inverse compensation is generated, i.e., the compensation multiplicator $$\left(\frac{THD3}{Pix'(p,q)}\right)^{\frac{1}{\gamma}}$$

is smaller than 1. In this case, the gray value (Pix(p,q)) has to be corrected, in which the gray value (Pix(p,q)) is first changed into a corrected gray value (Pix'(p,q)). When the gray value (Pix(p,q)) is smaller than (2×THD3−256), it remains unchanged. When the gray value (Pix(p,q)) is greater than or equal to (2×THD3−256), it is replaced with the corrected gray value (Pix'(p,q)), so that the corrected gray value (Pix'(p,q)) never becomes greater than THD3.

The pixels at darker areas of the backlight spread image have a gray value (Pix(p,q)) smaller than (2×THD3−256). In this case, each gray value (Pix(p,q)) corresponds to a compensation multi-plicator. Conversely, the pixels at lighter areas of the backlight spread image have a gray value (Pix(p, q)) greater than or equal to (2×THD3−256). In this case, two gray values (Pix(p,q)) may concurrently correspond to the same compensation multiplicator. In such a compensation, the number of compensation multiplicators is THD3, which is close to 256. Accordingly, the invention has a high-resolution compensation multiplicator to avoid the ripple effect.

Furthermore, if the different pixels of the image 10 have the same gray value as corresponding pixels of the backlight spread image, they also have the same compensation multiplicator. Thus, the number of compensation multiplicators stored in a lookup table is THD3, which can simplify the hardware complexity.

The backlight driving circuit 160 is connected to the temporal filter 130 for receiving the backlight pulse width modulation signal ($v_{dyn}$) so as to respectively control and drive the backlight sources 193.

The timing control circuit 170 is connected to the image compensation unit 150 for receiving the compensated image and generating a timing control signal. The panel driving circuit 180 is connected to the timing control circuit 170 for receiving the timing control signal and the compensated image so as to control and drive the panel 190, respectively.

Figure 5:
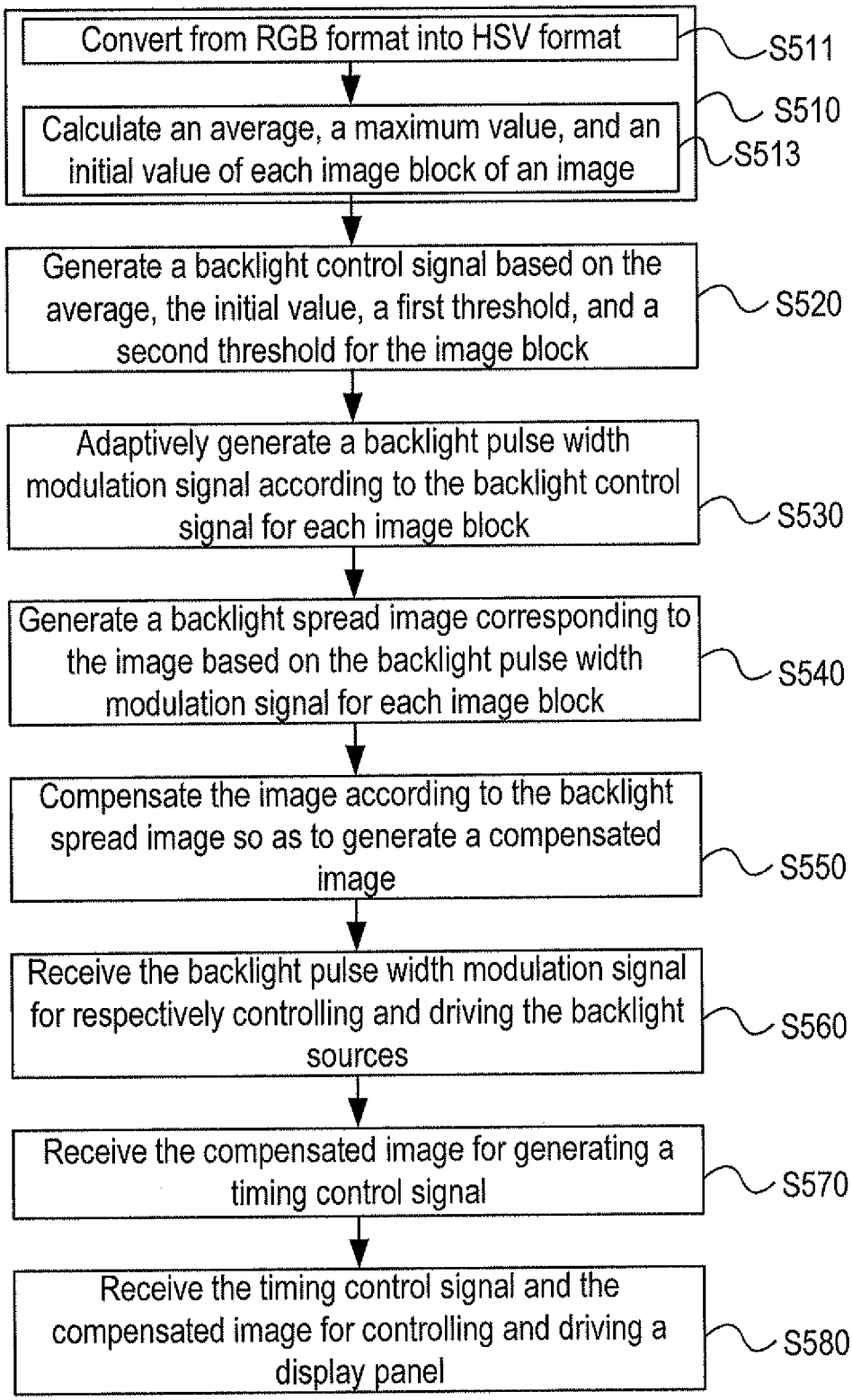
FIG. 5 is a flowchart of a method of compensating image in a backlight local dimming system in accordance with an embodiment of the invention.

FIG. 5 is a flowchart of a method of image compensation in backlight local dimming in accordance with an embodiment of the invention. As shown in FIGS. 1 and 5, the method estimates the values of pixels of the image 10 after backlight spreading of a plurality of backlight sources 193 in a backlight local dimming system and uses the estimated values to generate a backlight spread image for compensating the image 10. The backlight sources 193 are arranged in a matrix form. The image 10 is divided into a number of image blocks 11 corresponding to of the plurality of backlight sources, respectively. First, a block dimming value decision step (S510) receives the image and calculates an average value and a maximum value for each image block 11, so as to further calculate an initial value based on the average value and the maximum value for the image block 11.

The block dimming value decision step (S510) further includes an RGB to HSV conversion step (S511) and a computation step (S513).

The RGB to HSV conversion step (S511) receives the image 10 and converts it from RGB format into HSV format. The format conversion performed by the RGB to HSV conversion step (S511) can be expressed as follows:

$$v = \max(r, g, b),$$

where r, g, b indicate red value, green value, blue value of one pixel of the image 10, and v indicates v value of the pixel of the image 10.

The computation step (S513) calculates the average value and the maximum value for each image block 11 of the image 10 and further calculates the initial value based on the average value and the maximum value for the image block 11.

The calculation of average value for each image block 11 executed by the computation step (S513) can be expressed as follows:

$$v_{avg} = \frac{1}{N}\sum_{i=1}^{N} v_i,$$

where $v_i$ indicates v value of i-th pixel of an image block 11 of image 10 in HSV format, N indicates the number of pixels of the image block 11, and $v_{avg}$ indicates an average value of the image block 11.

The calculation of maximum value for each image block 11 executed by the computation step (S513) can be expressed as follows:

$$v_{max} = \max(v_1, v_2, v_2, \ldots, v_N),$$

where $v_{max}$ indicates a maximum value of the image block 11.

The calculation of initial value for each image block 11 executed by the computation step (S513) can be expressed as follows:

$$v_{init} R_S \times v_{max} + (1 - R_S) \times v_{avg},$$

where $v_{init}$ indicates an initial value of the image block 11, and $R_S$ is a weighting factor with a value of 0-1.

A quality/power-saving priority decision step (S520) generates a backlight control signal $v_{plt}$ based on the average value $v_{avg}$, the initial value $v_{init}$, a first threshold THD1, and a second threshold THD2 for each image block 11.

The backlight control signal $v_{plt}$ generated by the quality/power-saving priority decision step (S520) can be expressed as follows:

$$v_{plt} = \begin{cases} \dfrac{v_{init} \times BL_H}{THD2}, & \text{if } (v_{avg} < THD1) \text{ and } (v_{init} < THD2) \\ BL_H & \text{else,} \end{cases}$$

where $v_{plt}$ indicates the backlight control signal of the image block 11, $BL_H$ indicates a highest backlight dimming value, THD1 indicates the first threshold, and THD2 indicates the second threshold.

A temporal filtering step (S530) 130 adaptively generates a backlight pulse width modulation signal ($v_{dyn}$) in accordance with the backlight control signal for each image block 11.

The backlight pulse width modulation signal ($v_{dyn}$) generated by the temporal filtering step (S530) can be expressed as follows:

$$v_{dyn} = r_d \times v_{plt}^{(k)} + (1 - r_d) \times v_{plt}^{(k-1)},$$

$$r_d = B + \left\lfloor \frac{\sum_{j=1}^{M} (v_{avg}^{(k)})_j - \sum_{j=1}^{M} (v_{avg}^{(k-1)})_j}{L} \right\rfloor \times \frac{(1 - B)}{T},$$

where $r_d$ indicates a weighting factor, M indicates a number of image blocks, $v_{plt}^{(k)}$ indicates a backlight control signal of an image block 11 from a current frame of the image 10, $v_{plt}^{(k-1)}$ indicates a backlight control signal of an image block 11 of a previous frame of the image 10, $v_{avg}^{(k)}$ indicates an average value of entire brightness from the current frame of the image 10, $v_{avg}^{(k-1)}$ indicates an average value of entire brightness from the previous frame of the image 10, B indicates an intercept of the temporal filter, T indicates a varying step of the temporal filter, and L indicates a varying period of the temporal filter.

The current frame and the previous frame are used in a temporal axis in order to adaptively decide the backlight pulse width modulation signal ($v_{dyn}$). When the average values $v_{avg}^{(k)}$, $v_{avg}^{(k-1)}$ of entire brightness between the current frame and the previous frame are similar, the information associated with the previous frame is used in backlight local dimming. Otherwise, the information associated with the current frame is used in backlight local dimming. When the average values $v_{avg}^{(k)}$, $v_{avg}^{(k-1)}$ of entire brightness between the current frame and the previous frame are similar, it indicates that the images between the previous frame and the current frame have a very high similarity. In this case, the information associated with the previous frame is used in backlight local dimming to avoid the inter-frame flickering effect. When a darker frame follows a light frame, the average values $v_{avg}^{(k)}$, $v_{avg}^{(k-1)}$ of entire brightness between the current frame and the previous frame are not similar. In this case, the information associated with the current frame is used in backlight local dimming to avoid backlight from having insufficient brightness for a light frame and from having insufficient darkness for a darker frame.

A backlight spread approximation step (S540) generates a backlight spread image based on the backlight pulse width modulation signal for each image block 11.

An image compensation step (S550) compensates the image 10 based on the backlight spread image so as to generate a compensated image.

The image compensation operation performed by the image compensation step (S550) can be expressed as follows:

$$r_{comp} = \begin{cases} r, & \text{if } Pix'(p, q) = 0 \\ r \times \left(\dfrac{THD3}{Pix'(p, q)}\right)^{\frac{1}{\gamma}}, & \text{else,} \end{cases}$$

$$g_{comp} = \begin{cases} g, & \text{if } Pix'(p, q) = 0 \\ g \times \left(\dfrac{THD3}{Pix'(p, q)}\right)^{\frac{1}{\gamma}}, & \text{else,} \end{cases}$$

$$b_{comp} = \begin{cases} b, & \text{if } Pix'(p, q) = 0 \\ b \times \left(\dfrac{THD3}{Pix'(p, q)}\right)^{\frac{1}{\gamma}}, & \text{else,} \end{cases}$$

$$Pix'(p, q) = \begin{cases} Pix(p, q), & \text{if } Pix(p, q) < (2 \times THD3 - 256) \\ \dfrac{Pix(p, q)}{2} + \dfrac{1}{2} \times (2 \times THD3 - 256), & \text{if } Pix(p, q) \geq (2 \times THD3 - 256) \end{cases}$$

where r, g, b indicate red value, green value, blue value of one pixel of the image 10, $r_{comp}$, $g_{comp}$, $b_{comp}$ indicate red value, green value, blue value of one pixel of the compensated image, Pix(p, q) indicates gray value of a pixel at a coordinate (p, q) of the backlight spread image, $\gamma$=2.2, and THD3 indicates a third threshold.

When Pix'(p,q)≠0, $r_{comp}$, $g_{comp}$, $b_{comp}$ are respectively multiplied by the same compensation multiplicator $$\left(\frac{THD3}{Pix'(p, q)}\right)^{\frac{1}{\gamma}},$$

to thus reduce the color shift between the image 10 and the compensated image. The third threshold indicates a parameter associated with the compensation magnitude. The compensation reaches to the most magnitude when THD3=255, and the gray value (Pix(p,q)) of the pixel of the backlight spread image is smaller than the third threshold when THD3<255. Otherwise, an inverse compensation is generated, i.e., the compensation multi-plicator $$\left(\frac{THD3}{Pix'(p, q)}\right)^{\frac{1}{\gamma}}$$

is smaller than 1, and in this case the gray value (Pix(p,q)) has to be corrected, in which the gray value (Pix(p,q)) is first changed into a corrected gray value Pix'(p,q)). When the gray value (Pix(p,q)) is smaller than (2×THD3−256), it remains unchanged. When the gray value (Pix(p,q)) is greater than or equal to (2×THD3−256), it is replaced with the corrected gray value (Pix'(p,q)), so the corrected gray value (Pix'(p,q)) never becomes greater than THD3.

The pixels at darker areas of the backlight spread image have a gray value (Pix(p,q)) smaller than (2×THD3−256), and in this case each gray value (Pix(p,q)) corresponds to a compensation multiplicator. Conversely, the pixels at lighter areas of the backlight spread image have a gray value (Pix(p, q)) greater than or equal to (2×THD3−256), and in this case two gray values (Pix(p,q)) may concurrently correspond to the same compensation multiplicator. In such a compensation, the number of compensation multiplicators is THD3, which is close to 256. Accordingly, the invention has a high-resolution compensation multiplicator to avoid the ripple effect.

A backlight driving step (S560) receives the backlight pulse width modulation signal ($v_{dyn}$) for respectively controlling and driving the backlight sources 193.

A timing control step (S570) receives the compensated image and generates a timing control signal. A panel driving step (S580) receives the timing control signal and the compensated image for controlling and driving the panel 190, respectively.

In view of the foregoing, it is known that the invention analyzes the content of the input image 10 to obtain an adaptive backlight pulse width modulation signal $v_{dyn}$ for accordingly compensating the image 10. Therefore, the invention is characterized in including the following features:

1. An image quality of near clipping free can be obtained, without causing the clipping effect of losing the details of lighter portions of the image when an image compensation is performed in the prior art, since the invention uses the adjustable first and second thresholds to eliminate the clipping effect when a backlight dimming is decided.

2. An low color shift image quality can be obtained since a minimum difference between the compensated image and the input or raw image is obtained in a color coordinate domain. For an image compensation, the invention multiplies red (r), green (g), blue (b) values of one pixel by the same compensation multiplicator $$\left(\frac{THD3}{Pix'(p,q)}\right)^{\frac{1}{\gamma}},$$

so as to reduce the color shift between the image and the compensated image.

3. The invention uses a temporal filter to adaptively decide the backlight pulse width modulation signal ($v_{dyn}$) for performing an adaptive dynamic backlight dimming, thereby eliminating the inter-frame flicking effect and improving the incorrect local backlight in adjacent light and dark frames.

4. An image can be divided into any number of image blocks, even for different specifications.

5. A proportion of power saving priority and/or quality priority can be adjusted in computation.

6. Both advantages of the enhanced contrast and the power saving under the backlight local control are obtained with almost having the raw image quality.

Although the present invention has been explained in relation to its preferred embodiment, it is to be understood that many other possible modifications and variations can be made without departing from the spirit and scope of the invention as hereinafter claimed.

What is claimed is:

1. An apparatus of compensating image in a backlight local dimming system for estimating pixels of the image in the backlight local dimming system after backlight spreading of a plurality of backlight sources, wherein the backlight sources being arranged in a matrix form, the image being divided into a plurality of image blocks corresponding to the plurality of backlight sources, respectively, the apparatus comprising:

a block dimming value decision unit, for receiving the image and calculating an average value and a maximum value for the image blocks, so as to calculate an initial value based on the average value and the maximum value for the image blocks respectively;

a quality/power-saving priority decision unit, connected to the block dimming value decision unit, for generating a backlight control signal based on the average value, the initial value, a first threshold, and a second threshold for the image blocks correspondingly;

a temporal filter, connected to the quality/power-saving priority decision unit, for adaptively generating a backlight pulse width modulation signal based on the backlight control signal for the image blocks correspondingly;

a backlight spread approximation unit, connected to the temporal filter, for generating a backlight spread image corresponding to the image based on the backlight pulse width modulation signal; and an image compensation unit, connected to the backlight spread approximation unit, for compensating the image based on the backlight spread image, so as to generate a compensated image.

2. The apparatus as claimed in claim 1, further comprising:

a backlight driving circuit, connected to the temporal filter, for receiving the backlight pulse width modulation signal to respectively control the backlight sources.

3. The apparatus as claimed in claim 2, further comprising:

a timing control circuit, for receiving the compensated image to generate a timing control signal; and a panel driving circuit, connected to the timing control circuit, for receiving the timing control signal and the compensated image so as to control a display panel.

4. The apparatus as claimed in claim 1, wherein the block dimming value decision unit comprises:

an RGB to HSV converter, for receiving and converting the image from RGB format into HSV format based on an equation as follows:

$$v=\max(r,g,b),$$

where r, g, b indicate red value, green value, blue value of one pixel of the image, and v indicates v value of the HSV format of the pixel of the image; and a computation unit, connected to the RGB to HSV converter, for calculating the average value, the maximum value and the initial value for the image block.

5. The apparatus as claimed in claim 4, wherein the average value is calculated by the computation unit based on an equation as follows:

$$v_{avg} = \frac{1}{N}\sum_{i=1}^{N} v_i,$$

where $v_i$ indicates v value of i-th pixel of the image block of the image in HSV format, N indicates a number of pixels of the image block, and $v_{avg}$ indicates the average value of the image block.

6. The apparatus as claimed in claim 5, wherein the maximum value is calculated by the computation unit based on an equation as follows:

$$v_{max}=\max(v_1,v_2,v_2,\ldots,v_N),$$

where $v_{max}$ indicates the maximum value of the image block.

7. The apparatus as claimed in claim 6, wherein the initial value is calculated by the computation unit based on an equation as follows:

$$v_{init}=R_S\times v_{max}+(1-R_S)\times v_{avg},$$

where $v_{init}$ indicates the initial value of the image block, and $R_S$ is a weighting factor.

8. The apparatus as claimed in claim 7, wherein the backlight control signal is generated by the quality/power-saving priority decision unit based on an equation as follows:

$$v_{plt}=\begin{cases}\dfrac{v_{init}\times BL_H}{THD2}, & \text{if } (v_{avg}<THD1) \text{ and } (v_{init}<THD2)\\ BL_H & \text{else,}\end{cases}$$

where $v_{plt}$ indicates the backlight control signal of the image block, $BL_H$ indicates a highest backlight dimming value, THD1 indicates the first threshold, and THD2 indicates the second threshold.

9. The apparatus as claimed in claim 8, wherein the backlight pulse width modulation signal is generated by the temporal filter based on equations as follows:

$$v_{dyn}=r_d\times v_{plt}^{(k)}+(1-r_d)\times v_{plt}^{(k-1)},$$

$$r_d=B+\left\lfloor\frac{\sum_{j=1}^{M}(v_{avg}^{(k)})_j-\sum_{j=1}^{M}(v_{avg}^{(k-1)})_j}{L}\right\rfloor\times\frac{(1-B)}{T},$$

where $r_d$ indicates a weighting factor, M indicates a number of image blocks, $v_{plt}^{(k)}$ indicates the backlight control signal of the image block from a current frame of the image, $v_{plt}^{(k-1)}$ indicates the backlight control signal of the image block of a previous frame of the image, $v_{avg}^{(k)}$ indicates an average value of entire brightness from the current frame of the image, $v_{avg}^{(k-1)}$ indicates an average value of entire brightness from the previous frame of the image, B indicates an intercept of the temporal filter, T indicates a varying step of the temporal filter, and L indicates a varying period of the temporal filter.

10. The apparatus as claimed in claim 9, wherein the temporal filter uses the current frame and the previous frame in a temporal axis to adaptively decide the backlight pulse width modulation signal, such that information associated with the previous frame is used when the average values of entire brightness between the current frame and the previous frame are similar, thereby avoiding an inter-frame flickering effect, and otherwise information associated with the current frame is used for avoiding backlight from having insufficient brightness for a light frame and from having insufficient darkness for a darker frame.

11. The apparatus as claimed in claim 8, wherein an image compensation operation is performed by the image compensation unit based on equations as follows:

$$r_{comp}=\begin{cases}r, & \text{if } Pix'(p,q)=0\\ r\times\left(\dfrac{THD3}{Pix'(p,q)}\right)^{\frac{1}{\gamma}}, & \text{else,}\end{cases}$$

-continued $$g_{comp}=\begin{cases}g, & \text{if } Pix'(p,q)=0\\ g\times\left(\dfrac{THD3}{Pix'(p,q)}\right)^{\frac{1}{\gamma}}, & \text{else,}\end{cases}$$

$$b_{comp}=\begin{cases}b, & \text{if } Pix'(p,q)=0\\ b\times\left(\dfrac{THD3}{Pix'(p,q)}\right)^{\frac{1}{\gamma}}, & \text{else,}\end{cases}$$

$$Pix'(p,q)=\begin{cases}Pix(p,q), & \text{if } Pix(p,q)<(2\times THD3-256)\\ \dfrac{Pix(p,q)}{2}+\dfrac{1}{2}\times(2\times THD3-256), & \text{if } Pix(p,q)\geq(2\times THD3-256)\end{cases}$$

where $r_{comp}$, $g_{comp}$, $b_{comp}$ indicate red value, green value, blue value of one pixel of the compensated image, Pix(p, q) indicates gray value of a pixel at a coordinate (p, q) of the backlight spread image, THD3 indicates a third threshold, and Pix'(p, q) indicates a corrected gray value.

12. The apparatus as claimed in claim 11, wherein the values $r_{comp}$, $g_{comp}$, $b_{comp}$ are respectively multiplied by same compensation multiplicator $$\left(\frac{THD3}{Pix'(p,q)}\right)^{\frac{1}{\gamma}}$$

when Pix'(p,q)≠0, so as to reduce a color shift between the image and the compensated image.

13. A method of compensating image for estimating pixels of the image in a backlight local dimming system after backlight spreading of a plurality of backlight sources, wherein the backlight sources being arranged in a matrix form, the image being divided into a plurality of image blocks corresponding to the plurality of backlight sources, respectively, the method comprising the steps of:

a block dimming value decision step, for receiving the image and calculating an average value and a maximum value for the image blocks respectively, so as to calculate an initial value based on the average value and the maximum value;

a quality/power-saving priority decision step, for receiving the average value and initial value and generating a backlight control signal based on the average value, the initial value, a first threshold, and a second threshold for the image blocks correspondingly;

a temporal filtering step, for generating a backlight pulse width modulation signal based on the backlight control signal for the image blocks respectively;

a backlight spread approximation step, for generating a backlight spread image corresponding to the image based on the backlight pulse width modulation signal for the image block respectively; and an image compensation step, for compensating the image based on the backlight spread image, so as to generate a compensated image.

14. The method as claimed in claim 13, wherein the block dimming value decision step comprises:

an RGB to HSV conversion step, for receiving and converting the image from RGB format into HSV format based on an equation as follows:

$$v=\max(r,g,b),$$

where r, g, b indicate red value, green value, blue value of one pixel of the image, and v indicates v value of the pixel of the image; and a computation step, for calculating the average value, the maximum value and the initial value for the image blocks respectively.

15. The method as claimed in claim 14, wherein the average value is calculated in the computation step based on an equation as follows:

$$v_{avg} = \frac{1}{N}\sum_{i=1}^{N} v_i,$$

where $v_i$ indicates v value of i-th pixel of the image block of the image in HSV format, N indicates a number of pixels of the image block, and $v_{avg}$ indicates the average value of the image block.

16. The method as claimed in claim 15, wherein the maximum value is calculated in the computation step based on an equation as follows:

$$v_{max}=\max(v_1,v_2,v_2,\ldots,v_N),$$

where $v_{max}$ indicates the maximum value of the image block.

17. The method as claimed in claim 16, wherein the initial value is calculated in the computation step based on an equation as follows:

$$v_{init}=R_S\times v_{max}+(1-R_S)\times v_{avg},$$

where $v_{init}$ indicates the initial value of the image block, and $R_S$ is a weighting factor.

18. The method as claimed in claim 17, wherein the backlight control signal is generated in the quality/power-saving priority decision step based on an equation as follow:

$$v_{plt} = \begin{cases} \dfrac{v_{init}\times BL_H}{THD2}, & \text{if } (v_{avg} < THD1) \text{ and } (v_{init} < THD2) \\ BL_H & \text{else,} \end{cases}$$

where $v_{plt}$ indicates the backlight control signal of the image block, $BL_H$ indicates a highest backlight dimming value, THD1 indicates the first threshold, and THD2 indicates the second threshold.

19. The method as claimed in claim 18, wherein the backlight pulse width modulation signal is generated in the temporal filtering step based on equations as follows:

$$v_{dyn} = r_d \times v_{plt}^{(k)} + (1 - r_d)\times v_{plt}^{(k-1)},$$

$$r_d = B + \left\lfloor \frac{\sum_{j=1}^{M}(v_{avg}^{(k)})_j - \sum_{j=1}^{M}(v_{avg}^{(k-1)})_j}{L} \right\rfloor \times \frac{(1-B)}{T},$$

where $r_d$ indicates a weighting factor, M indicates a number of image blocks, $v_{plt}^{(k)}$ indicates the backlight control signal of the image block from a current frame of the image, $v_{plt}^{(k-1)}$ indicates the backlight control signal of the image block from a previous frame of the image, $v_{avg}^{(k)}$ indicates an average value of entire brightness from the current frame of the image, $v_{avg}^{(k-1)}$ indicates an average value of entire brightness of the previous frame of the image, B indicates an intercept of a temporal filter used in the temporal filtering step, T indicates a varying step of the temporal filter, and L indicates a varying period of the temporal filter.

20. The method as claimed in claim 19, wherein the temporal filtering step uses the current frame and the previous frame in a temporal axis to decide the backlight pulse width modulation signal, such that information associated with the previous frame is used when the average values of entire brightness between the current frame and the previous frame are similar, thereby avoiding an inter-frame flickering effect, and otherwise information associated with the current frame is used for avoiding a backlight from having insufficient brightness for a light frame and from having insufficient darkness for a darker frame.

21. The method as claimed in claim 18, wherein an image compensation operation is executed in the image compensation step based on equations as follows:

$$r_{comp} = \begin{cases} r, & \text{if } Pix'(p,q) = 0 \\ r\times\left(\dfrac{THD3}{Pix'(p,q)}\right)^{\frac{1}{\gamma}}, & \text{else,} \end{cases}$$

$$g_{comp} = \begin{cases} g, & \text{if } Pix'(p,q) = 0 \\ g\times\left(\dfrac{THD3}{Pix'(p,q)}\right)^{\frac{1}{\gamma}}, & \text{else,} \end{cases}$$

$$b_{comp} = \begin{cases} b, & \text{if } Pix'(p,q) = 0 \\ b\times\left(\dfrac{THD3}{Pix'(p,q)}\right)^{\frac{1}{\gamma}}, & \text{else,} \end{cases}$$

$$Pix'(p,q) = \begin{cases} Pix(p,q), & \text{if } Pix(p,q) < (2\times THD3 - 256) \\ \dfrac{Pix(p,q)}{2} + \dfrac{1}{2}\times(2\times THD3 - 256), & \text{if } Pix(p,q) \geq (2\times THD3 - 256) \end{cases}$$

where $r_{comp}$, $g_{comp}$, $b_{comp}$ indicate red value, green value, blue value of one pixel of the compensated image, Pix(p, q) indicates gray value of a pixel at a coordinate (p, q) of the backlight spread image, THD3 indicates a third threshold, and Pix'(p, q) indicates a corrected gray value.

22. The method as claimed in claim 21, wherein the values $r_{comp}$, $g_{comp}$, $b_{comp}$ are respectively multiplied by same compensation multiplicator $$\left(\frac{THD3}{Pix'(p,q)}\right)^{\frac{1}{\gamma}}$$

when the corrected gray value Pix'(p,q)≠0, so as to reduce a color shift between the image and the compensated image.

* * * * *